US006141516A

United States Patent [19]

Law et al.

[11] Patent Number: 6,141,516

[45] **Date of Patent: *Oct. 31, 2000**

[54] FLUORINATED CARBON FILLED FLUOROELASTOMER OUTER LAYER

[75] Inventors: Kock-Yee Law; Joseph Mammino, both of Penfield; Gerald M. Fletcher, Pittsford; Martin A. Abkowitz, Webster; Ihor W. Tarnawskyj, Webster; Kathleen M. McGrane, Webster, all of N.Y.

[73] Assignee: Xerox Corporation, Stamford, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/672,803

[22] Filed: Jun. 28, 1996

[51] Int. Cl.[7] ..... G03G 15/02

[52] U.S. Cl. ..... 399/176; 428/334

[58] Field of Search ..... 399/115, 168, 399/174, 175, 176; 361/225; 427/387; 428/334

[56] References Cited

U.S. PATENT DOCUMENTS

| | | | |
|---|---|---|---|
| 3,929,920 | 12/1975 | Komo et al. | 260/653.9 |
| 4,118,235 | 10/1978 | Horiuchi et al. | 106/38.22 |
| 4,308,063 | 12/1981 | Horiuchi et al. | 106/38.22 |
| 4,348,363 | 9/1982 | Akiyama et al. | 422/192 |
| 4,427,803 | 1/1984 | Fukui et al. | 523/402 |
| 4,447,663 | 5/1984 | Akiyama et al. | 570/150 |
| 4,522,907 | 6/1985 | Mitsuhashi et al. | 430/102 |
| 4,524,119 | 6/1985 | Luly et al. | 430/108 |
| 4,840,675 | 6/1989 | Fukui et al. | 106/38.22 |
| 5,000,875 | 3/1991 | Kolouch | 252/511 |
| 5,017,432 | 5/1991 | Eddy et al. | 428/422 |
| 5,017,965 | 5/1991 | Hashimoto et al. | 355/219 |
| 5,035,950 | 7/1991 | De Rosario | 428/421 |
| 5,112,708 | 5/1992 | Okunuki et al. | 430/31 |
| 5,132,743 | 7/1992 | Bujese et al. | 355/274 |
| 5,166,031 | 11/1992 | Badesha et al. | 430/124 |
| 5,177,538 | 1/1993 | Mammino et al. | 355/259 |
| 5,208,638 | 5/1993 | Bujese et al. | 355/274 |
| 5,217,837 | 6/1993 | Henry et al. | 430/124 |
| 5,286,566 | 2/1994 | Schlueter, Jr. et al. | 428/413 |
| 5,303,014 | 4/1994 | Yu et al. | 355/273 |
| 5,338,587 | 8/1994 | Mammino et al. | 428/35.7 |
| 5,450,184 | 9/1995 | Yanai et al. | 355/299 |
| 5,547,797 | 8/1996 | Anno et al. | 430/106.6 |
| 5,587,110 | 12/1996 | Yamana et al. | 252/511 |
| 5,609,554 | 3/1997 | Hayashi et al. | 492/56 |
| 5,744,200 | 4/1998 | Badesha et al. | 427/387 |
| 5,849,399 | 12/1998 | Law et al. | 428/212 |

FOREIGN PATENT DOCUMENTS

| | | |
|---|---|---|
| 0596477A2 | 3/1993 | European Pat. Off. . |
| 0606907A1 | 1/1994 | European Pat. Off. . |
| 7160138 | 6/1995 | Japan . |
| 8-15960 | 1/1996 | Japan . |
| 8015960 | 1/1996 | Japan . |
| 8160759 | 6/1996 | Japan . |

OTHER PUBLICATIONS

JP 08015960A Abstract (Complete Application to Follow).

Book entitled: "Macromolecular Design of Polymeric Materials", Edited by: Koichi Hatada and Tatsuki Kitayama, from from Chapter 25 (pp. 435–438).

"Accufluor® Fluorinated Carbon: Summary of Properties" Allied Corporation (Product Data Series 2000) 1995.

*Primary Examiner*—Quana M. Grainger

*Attorney, Agent, or Firm*—Annette L. Bade; Judith L. Byorick

[57] ABSTRACT

A bias charging member capable of receiving a bias for contact charging a member to be charged, wherein the bias charging member has an electrically conductive core, an optional intermediate layer, and an outer surface layer comprising a fluorinated carbon filled fluoroelastomer is disclosed.

40 Claims, 3 Drawing Sheets

FLUORINATED CARBON FILLED FLUOROELASTOMER OUTER LAYER

CROSS REFERENCE TO RELATED APPLICATIONS

Attention is directed to the following copending applications assigned to the assignee of the present application: U.S. application Ser. No. 08/635,356 filed Apr. 19, 1996, entitled, "Biasable System Members;" U.S. application Ser. No. 08/706,387 filed Aug. 30, 1996, entitled, "On Fuser System Members;" U.S. application Ser. No. 08/779,287, filed Jan. 21, 1997, entitled, "Liquid Developer Intermediate Transfer Members;" U.S. application Ser. No. 08/706,057 filed Aug. 30, 1996, entitled "Fixing Apparatus and Film;" and U.S. application Ser. No. 08/786,614, filed Jan. 21, 1997, entitled "Ohmic Contact-Providing Compositions". The disclosures of each of these applications are hereby incorporated by reference in their entirety.

BACKGROUND OF THE INVENTION

The present invention relates to elastomer layers and a process for forming the elastomer layers, and more specifically, to fluorinated carbon filled elastomers useful as layers for electrostatographic members, especially xerographic members such as bias charging members, and methods thereof. In embodiments, there are selected fluorinated carbon filled elastomers which are useful as layers for components in electrostatographic processes, especially xerographic processes, including bias charging rolls, belts and other members, for example, bias charging belts, films and rolls, and the like. In embodiments, the present invention allows for the preparation and manufacture of bias charging members with superior electrical and mechanical properties, including controlled and uniform conductivity in a desired resistivity range, and increased mechanical strength, durometer, tensile strength, elongation and toughness. Further, in embodiments, the layers also exhibit excellent properties such as statistical insensitivity of conductivity to changes in temperature and humidity, intense continuous corona exposure, corrosive environments, solvent treatment, running time or cycling to high electric fields and back. Also, in embodiments, the layers permit a decrease in contamination of other xerographic components such as photoconductors. In addition, the present invention, in embodiments, allows for use of a single DC bias. Moreover, in embodiments, ozone contamination is decreased, and thus the biasable charging members are more environmentally friendly.

In a conventional charging step included in electrophotographic processes using an electrophotographic photosensitive member, in most cases a high voltage (DC voltage of about 5–8 KV) is applied to a metal wire to generate a corona, which is used for the charging. In this method, however, a corona discharge product such as ozone and $NO_x$ is generated along with the generation of the corona. Such a corona discharge product deteriorates the photosensitive member surface and may cause deterioration of image quality such as image blurring or fading or the presence of black streaks across the copy sheets. Further, ozone contamination may be harmful to humans if released in relatively large quantities. In addition, the photosensitive member which contains an organic photoconductive material is susceptible to deterioration by the corona products.

Also, as the power source, the current directed toward the photosensitive member is only about 5 to 30% thereof. Most of the power flows to the shielding plate. Thus, the efficiency of the charging means is low.

For overcoming or minimizing such drawbacks, methods of charging have been developed using a direct charging member for charging the photosensitive member. For example, U.S. Pat. No. 5,017,965 to Hashimoto et al, the subject matter of which is hereby incorporated by reference in its entirety, discloses a charging member having a surface layer which comprises a polyurethane resin. Also, European Patent Application 0 606 907 A1, the subject matter of which is hereby incorporated by reference in its entirety, discloses a charging roller having an elastic layer comprising epichlorohydrin rubber, and a surface layer thereover comprising a fluorine containing bridged copolymer.

These and other known charging members are used for contact charging for charging a charge-receiving member (photoconductive member) through steps of applying a voltage to the charging member and disposing the charging member being in contact with the charge-receiving member. Such bias charging members require a resistivity of the outer layer within a desired range. Specifically, materials with too low resistivities will cause shorting and/or unacceptably high current flow to the photoconductor. Materials with too high resistivities will require unacceptably high voltages. Other problems which can result if the resistivity is not within the required range include nonconformance at the contact nip, poor toner releasing properties and generation of contaminant during charging. These adverse affects can also result in that the bias charging members tend to have non-uniform resistivity across the length of the contact member. It is usually the situation that most of the charge is associated at or near the center of the charge member. The charge seems to decrease at points farther away from the center of the charge member. Other problems include resistivity that is susceptible to changes in temperature, relative humidity, running time, and leaching out of contamination to photoconductors.

Other factors affecting bias charging member performance include the use of AC and/or DC potential. Typically, an AC potential is normally used along with a DC "controlling potential" to aid charging control. The advantage of using AC lies in the reduction of surface contamination sensitivity. The use of AC creates a corona in the pre and post nip regions of the device so that the charging component related to charge injection in the nip is less important. This "injection component" is very sensitive to the surface properties of the materials and is a large factor for preventing charging non-uniformity which may occur when only DC is used.

However, the AC current required for operating the AC bias system is proportional to the process speed. This limits the application of bias devices to low speed machines. Also, the AC power supply is relatively expensive. Therefore, it is desirable from a cost and design standpoint to have a single DC bias system. This requires materials with an optimum and stable resistivity. Otherwise, use of a single bias will cause pre-nip breakdown, charging non-uniformity, and contamination.

Attempts at controlling the resistivity within the desired range have focused on controlling the resistivity range at the pre and post nip areas. These attempts have included adding ionic additives to the elastomer layers. European Patent Application 0 596 477 A2, the subject matter of which is hereby incorporated by reference in its entirety, discloses a charging member comprising at least an elastic layer comprising epichlorohydrin rubber and a surface layer disposed thereon, the surface layer comprising at least a semiconductive resin and an insulating metal oxide contained in the semiconductive resin. While addition of ionic additives to elastomers may partially control the resistivity of the elastomers to some extent, there are problems associated with the use of ionic additives. In particular, undissolved particles frequently appear in the elastomer which causes an imperfection in the elastomer. This leads to a nonuniform resistivity, which in turn, leads to poor transfer properties and poor mechanical strength. Furthermore, bubbles appear in the conductive elastomer, some of which can only be seen with the aid of a microscope, others of which are large enough to be observed with the naked eye. These bubbles provide the same kind of difficulty as the undissolved particles in the elastomer namely, poor or nonuniform electrical properties, poor mechanical properties such as durometer, tensile strength, elongation, a decrease in the modulus and a decrease in the toughness of the material. In addition, the ionic additives themselves are sensitive to changes in temperature, humidity, operating time and applied field. These sensitivities often limit the resistivity range. For example, the resistivity usually decreases by up to two orders of magnitude or more as the humidity increases from 20% to 80% relative humidity. This effect limits the operational or process latitude. Moreover, ion transfer can also occur in these systems. The transfer of ions will lead to contamination problems, which in turn, can reduce the life of the machine. Ion transfer also increases the resistivity of the elastomer member after repetitive use. This can limit the process and operational latitude and eventually, the ion-filled elastomer component will be unusable.

Conductive particulate fillers, such as carbons, have also been used in an attempt to control the resistivity. U.S. Pat. No. 5,112,708 to Okunuki et al., the disclosure of which is hereby incorporated by reference in its entirety, discloses a charging member comprising a surface layer formed of N-alkoxymethylated nylon which may be filled with fluorinated carbon. Generally, carbon additives control the resistivities and provide stable resistivities upon changes in temperature, relative humidity, running time, and leaching out of contamination to photoconductors. However, carbon particles disperse poorly in elastomers. Further, the required tolerance in the filler loading to achieve the required range of resistivity has been extremely narrow. This along with the large "batch to batch" variation leads to the need for extremely tight resistivity control. In addition, carbon filled elastomer surfaces have typically had very poor dielectric strength and sometimes significant resistivity dependence on applied fields. This leads to a compromise in the choice of centerline resistivity due to the variability in the electrical properties, which in turn, ultimately leads to a compromise in performance.

Therefore, there exists a specific need accomplished with the present invention in embodiments thereof for an elastomer outer surface for charging members which allows for a stable conductivity in the desired resistivity range without the problems associated with ionic additives and carbon additives.

SUMMARY OF THE INVENTION

Examples of objects of the present invention include:

It is an object of the present invention to provide bias charging system members and methods thereof with many of the advantages indicated herein.

Further, it is an object of the present invention to provide bias system members and methods thereof which have more uniform electrical properties including resistivity across the entire length of the member.

Another object of the present invention is to provide bias charging system members and methods thereof which enable control of electrical properties including the control of conductivity in the desired resistivity range.

It is a further object of the present invention to provide bias charging system members and methods thereof which have more stable mechanical properties such as mechanical strength, durometer, tensile strength, elongation and toughness.

Yet another object of the present invention is to provide bias charging system members and methods thereof which have decreased resistivity sensitivities to changes in temperature, relative humidity, corona exposure, corrosive environments, solvent treatment, cycling to high electric fields, and running or operating time.

Still another object of the present invention is to provide bias charging system members and methods thereof which decrease contamination of other xerographic components such as photoconductors.

It is another object of the present invention to provide bias charging system members and methods thereof which enable the use of a single bias.

Many of the above and other objects have been met by the present invention, in embodiments, which includes: a bias charging member, wherein said bias charging member comprises: a) a conductive core, b) an optional intermediate layer provided on said core, and c) an outer surface layer provided on said intermediate layer and comprising a fluorinated carbon filled fluoroelastomer.

Embodiments further include: a bias charging member, wherein said bias charging member comprises: a) a conductive core, and b) an outer surface layer provided on said core and comprising a fluorinated carbon filled fluoroelastomer, wherein the fluorinated carbon is of the formula $CF_x$, wherein x represents the number of fluorine atoms and is from about 0.02 to about 1.5 and said fluoroelastomer is selected from the group consisting of a) copolymers of vinylidenefluoride and hexafluoropropylene, and b) terpolymers of vinylidenefluoride, hexafluoropropylene and tetrafluoroethylene.

Embodiments further include: a bias charging member, wherein said bias charging member comprises: a) a conductive core; b) an intermediate layer provided on the conductive core, said intermediate layer comprising an elastomer selected from the group consisting of silicone rubbers, ethylene-propylene-diene monomer, epichlorohydrin, styrene-butadiene, fluorosilicone, polyurethane elastomers and copolymers thereof, and c) an outer surface layer provided on said intermediate layer and comprising a fluorinated carbon filled fluoroelastomer, wherein the fluorinated carbon is of the formula $CF_x$, wherein x is from about 0.02 to about 1.5 and said fluoroelastomer is selected from the group consisting of 1) copolymers of vinylidenefluoride and hexafluoropropylene, and 2) terpolymers of vinylidenefluoride, hexafluoropropylene and tetrafluoroethylene.

The bias charging system members and methods thereof provided herein, the embodiments of which are further described herein, enable control of the desired resistivities; allow for uniform electrical properties including resistivity; have more stable mechanical properties such as mechanical strength, durometer, tensile strength, elongation and toughness; have improved resistivity insensitivities to environmental and mechanical changes such as changes in temperature, relative humidity, corona exposure, corrosive environment, solvent treatment, cycling to high electric fields and running time; decrease contamination of other xerographic components such as photoconductors; and allow for use of a single bias system.

DETAILED DESCRIPTION OF THE PRESENT INVENTION

Figure 1:
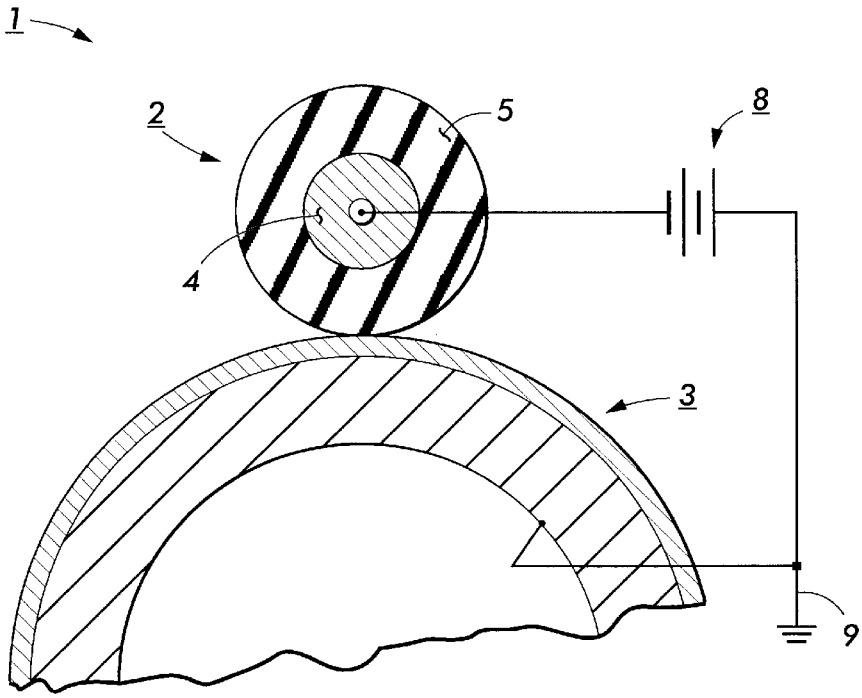
FIG. 1 demonstrates an embodiment of the invention which includes a bias charging roll having an electrically conductive core and an outer surface layer provided thereon.
Figure 4:
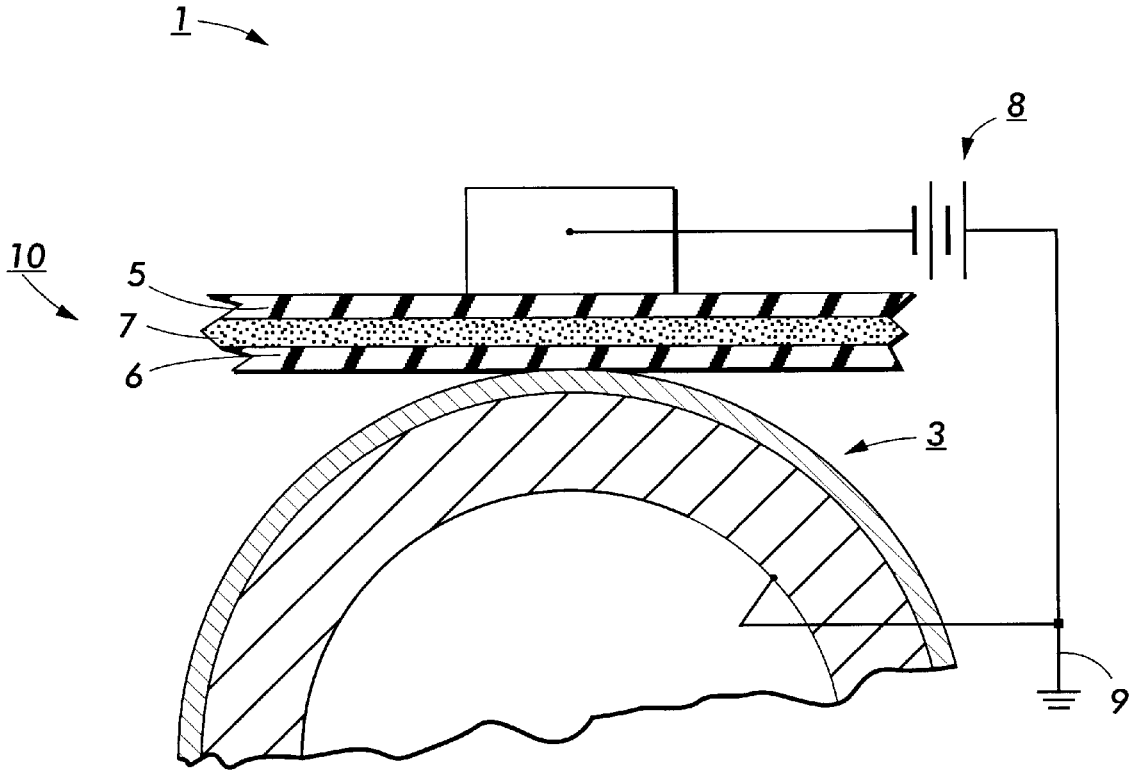
FIG. 4 demonstrates an embodiment of the invention which includes a bias charging belt, film or sheet.

Referring to FIG. 1, there is shown an embodiment of the present charging system including a charging device 1 having a charge roller 2 or charge belt, sheet, or film 10 depicted in FIG. 4, held in contact with an image carrier implemented as a photoconductive drum 3. However, the present invention can be used for charging a dielectric receiver or other suitable member to be charged. The photoconductive member may be a drum or a belt or other known photoconductive member. While the charge roller is in rotation, a DC voltage and optional AC current is applied from a power source 9 to the core of the roller 2 to cause it to charge the photosensitive member 3. The charge roller 2 has a conductive core 4 which is comprised of a conductive material such as, for example, a metal. In the embodiment shown, the conductive core 4 is surrounded by a conductive layer 5 comprised of a conductive material such as, for example, a conductive rubber such as a fluoroelastomer. Conductive layer 5 has conductive particles dispersed therein, such as, for example fluorinated carbon.

Figure 2:
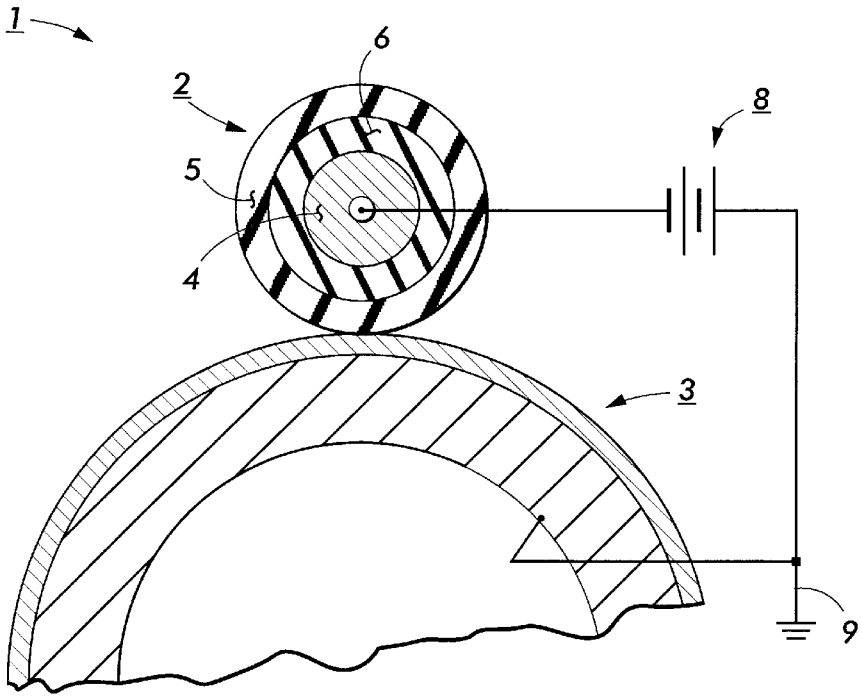
FIG. 2 demonstrates an embodiment of the invention which includes a bias charging roll having an electrically conductive core, an intermediate layer provided thereon and an outer surface layer provided on the intermediate layer.
Figure 3:
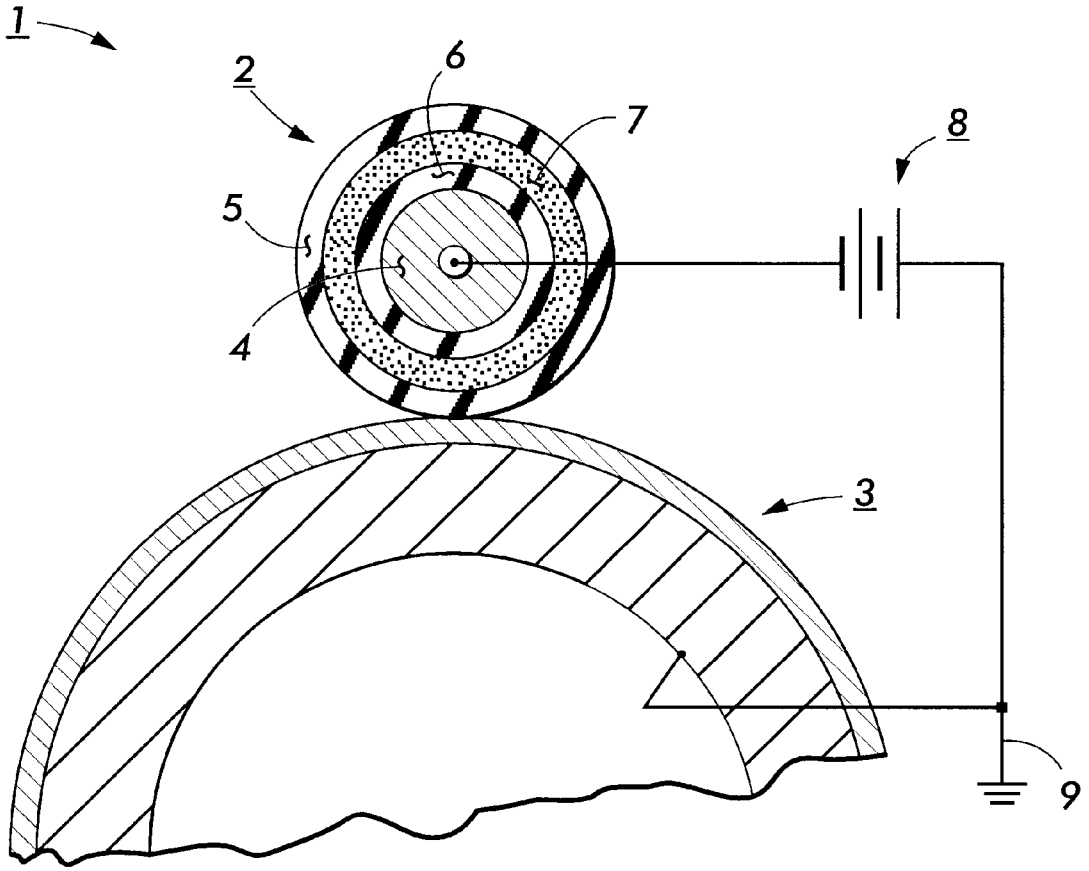
FIG. 3 demonstrates an embodiment of the invention which includes a bias charging roll having an electrically conductive core, an intermediate layer provided thereon and an outer surface layer provided on the intermediate layer, and optionally including adhesive layers between the core and intermediate layer and/or between the intermediate layer and the outer layer.

Referring to FIG. 2, there is shown another preferred embodiment of the invention, including all of the elements of FIG. 1 and including an optional intermediate conductive rubber layer 6 positioned between the outer conductive fluorinated carbon filled fluoroelastomer layer 5 and the inner core 4. The intermediate conductive rubber layer may be comprised of, for example, silicone, EPDM, urethane, epichlorohydrin, etc. FIG. 3 shows an alternative preferred embodiment of the present invention including the elements of FIGS. 1 and 2, and including an optional intermediate adhesive layer 7 positioned between the intermediate conductive rubber layer 6 and the outer fluorinated carbon filled fluoroelastomer layer 5.

The outer surface 5 of the bias charging system members of the present invention contains fluorinated carbon filled fluoroelastomers. The fluorinated carbon is believed to crosslink with the fluoroelastomer upon curing of the surface coating. The particular resistivity can be chosen and controlled depending on the amount of fluorinated carbon, the kind of curative, the amount of curative, the amount of fluorine in the fluorinated carbon, and the curing procedures including the specific curing agent, curing time and curing temperature.

The resistivity can be selected not only by utilizing the appropriate curing agents, curing time and curing temperature as set forth herein, but also by selecting a specific fluorinated carbon, or mixtures of various types of fluorinated carbon. The percentage of fluorine in the fluorinated carbon will also affect the resistivity of the fluoroelastomer when mixed therewith. The fluorinated carbon crosslinked with an elastomer provides embodiments superior results by providing a bias charging member outer surface having a resistivity within the desired range which is virtually unaffected by numerous environmental and mechanical changes.

Fluorinated carbon, sometimes referred to as graphite fluoride or carbon fluoride is a solid material resulting from the fluorination of carbon with elemental fluorine. The number of fluorine atoms per carbon atom may vary depending on the fluorination conditions. The variable fluorine atom to carbon atom stoichiometry of fluorinated carbon permits systemic, uniform variation of its electrical resistivity properties. Controlled and specific resistivity is a highly desired feature for an outer surface of a bias charging system member.

Fluorinated carbon is a specific class of compositions which is prepared by the chemical addition of fluorine to one or more of the many forms of solid carbon. In addition, the amount of fluorine can be varied in order to produce a specific, desired resistivity. Fluorocarbons are either aliphatic or aromatic organic compounds wherein one or more fluorine atoms have been attached to one or more carbon atoms to form well defined compounds with a single sharp melting point or boiling point. Fluoropolymers are linked-up single identical molecules which comprise long chains bound together by covalent bonds. Moreover, fluoroelastomers are a specific type of fluoropolymer. Thus, despite some confusion in the art, it is apparent that fluorinated carbon is neither a fluorocarbon nor a fluoropolymer and the phrase fluoronated carbon is used in this context herein.

The fluorinated carbon material may be any of the fluorinated carbon materials as described herein. The methods for preparation of fluorinated carbon are well known and documented in the literature, such as in the following U.S. Pat. Nos. 2,786,874; 3,925,492; 3,925,263; 3,872,032 and 4,247,608, the disclosures of which are totally incorporated by reference herein. Essentially, fluorinated carbon is produced by heating a carbon source such as amorphous carbon, coke, charcoal, carbon black or graphite with elemental fluorine at elevated temperatures, such as 150°–600° C. A diluent such as nitrogen is preferably admixed with the fluorine. The nature and properties of the fluorinated carbon vary with the particular carbon source, the conditions of reaction and with the degree of fluorination obtained in the final product. The degree of fluorination in the final product may be varied by changing the process reaction conditions, principally temperature and time. Generally, the higher the temperature and the longer the time, the higher the fluorine content.

Fluorinated carbon of varying carbon sources and varying fluorine contents is commercially available from several sources. Preferred carbon sources are carbon black, crystalline graphite and petroleum coke. One form of fluorinated carbon which is suitable for use in accordance with the invention is polycarbon monofluoride which is usually written in the shorthand manner $CF_x$ with x representing the number of fluorine atoms and generally being up to about 1.2, preferably from about 0.02 to about 1.5, and particularly preferred from about 0.04 to about 1.4. $CF_x$ has a lamellar structure composed of layers of fused six carbon rings with fluorine atoms attached to the carbons and lying above and below the plane of the carbon atoms. Preparation of $CF_x$ type fluorinated carbon is described, for example, in abovementioned U.S. Pat. Nos. 2,786,874 and 3,925,492, the disclosures of which are incorporated by reference herein in their entirety. Generally, formation of this type of fluorinated carbon involves reacting elemental carbon with $F_2$ catalytically. This type of fluorinated carbon can be obtained commercially from many vendors, including Allied Signal, Morristown, N.J.; Central Glass International, Inc., White Plains, N.Y.; Daikin Industries, Inc., New York, N.Y.; and Advanced Research Chemicals, Inc., Catoosa, Okla.

Another form of fluorinated carbon which is suitable for use in accordance with the invention is that which has been postulated by Nobuatsu Watanabe as poly(dicarbon monofluoride) which is usually written in the shorthand manner $(C_2F)_n$, wherein n represents the number of $C_2F$ components. Preparation of $(C_2F)_n$ type fluorinated carbon is described, for example, in above-mentioned U.S. Pat. No. 4,247,608, the disclosure of which is herein incorporated by reference in its entirety, and also in Watanabe et al., "Preparation of Poly(dicarbon monofluoride) from Petroleum Coke", Bull. Chem. Soc. Japan, 55, 3197–3199 (1982), the disclosure of which is also incorporated herein by reference in its entirety.

In addition, preferred fluorinated carbons useful herein include those described in U.S. Pat. No. 4,524,119 to Luly et al., the subject matter of which is hereby incorporated by reference in its entirety, and those having the tradename Accufluor®, (Accufluor® is a registered trademark of Allied Signal, Morristown, N.J.) for example, Accufluor® 2028, Accufluor® 2065, Accufluor® 1000, and Accufluor® 2010. Accufluor® 2028 and Accufluor® 2010 have 28 and 11 percent fluorine content, respectively. Accufluor® 1000 and Accufluor® 2065 have 62 and 65 percent fluorine content respectively. Also, Accufluor® 1000 comprises carbon coke, whereas Accufluor® 2065, 2028 and 2010 all comprise conductive carbon black. These fluorinated carbons have the formula $CF_x$ and are formed by the reaction of $C+F_2=Cf_x$.

The following chart demonstrates some properties of four preferred fluorinated carbons useful in the present invention.

| PROPERTIES | ACCUFLUOR | | | | UNITS |
|---|---|---|---|---|---|
| GRADE | 1000 | 2065 | 2028 | 2010 | N/A |
| Feedstock | Coke | Conductive Carbon Black | | | N/A |
| Fluorine Content | 62 | 65 | 28 | 11 | % |
| True Density | 2.7 | 2.5 | 2.1 | 1.9 | g/cc |
| Bulk Density | 0.6 | 0.1 | 0.1 | 0.09 | g/cc |
| Decomposition Temperature | 630 | 500 | 450 | 380 | ° C. |
| Median Particle Size | 8 | <1 | <1 | <1 | micrometers |
| Surface Area | 130 | 340 | 130 | 170 | $m^2/g$ |
| Thermal Conductivity | $10^{-3}$ | $10^{-3}$ | $10^{-3}$ | N.A | cal/cm-sec-° C. |
| Electrical Resistivity | $10^{11}$ | $10^{11}$ | $10^{8}$ | <10 | ohm-cm |
| Color | Gray | White | Black | Black | N/A |

As has been described herein, it is a major advantage of the invention to be able to vary the fluorine content of the fluorinated carbon to permit systematic uniform variation of the resistivity properties of the biasable charging member. The preferred fluorine content will depend on the equipment used, equipment settings, desired resistivity, and the specific fluoroelastomer chosen. The fluorine content in the fluorinated carbon is from about 1 to about 70 weight percent (carbon content of from about 99 to about 30 percent by weight) based on the weight of fluorinated carbon, preferably from about 5 to about 65 (carbon content of from about 95 to about 35 weight percent), and particularly preferred from about 10 to about 30 weight percent (carbon content of from about 90 to about 70 weight percent).

The median particle size of the fluorinated carbon can be less than 1 micron and up to 10 microns, is preferably less than 1 micron, and particularly preferred from about 0.5 to 0.9 micron. The surface area is preferably from about 100 to about 400 $m^2/g$, preferred of from about 110 to about 340, and particularly preferred from about 130 to about 170 $m^2/g$. The density of the fluorinated carbons is preferably from about 1.5 to about 3 g/cc, preferably from about 1.9 to about 2.7 g/cc.

The amount of fluorinated carbon used is for example from about 1 to about 40, and preferably from about 3 to about 30 percent based on the weight of total solids. An amount of from 5 to about 15 percent fluorinated carbon based on the weight of total solids is desired. Total solids as used herein refers to the amount of fluoroelastomer and/or other elastomers.

It is preferable to mix different types of fluorinated carbon to tune the mechanical and electrical properties. It is desirable to use mixtures of different kinds of fluorinated carbon to achieve good conductivity while reducing the hardness of the layer. Also, mixtures of different kinds of fluorinated carbon can provide an unexpected wide formulation latitude and controlled and predictable conductivity. For example, an amount of from about 0 to about 40 percent, and preferably from about 1 to about 35 percent by weight of Accufluor 2010 can be mixed with an amount of from about 0 to about 40 percent, preferably from about 1 to about 35 percent Accufluor 2028, and particularly preferred from about 8 to about 25 percent Accufluor 2028. Other forms of fluorinated carbon can also be mixed. Another example is an amount of from about 0 to about 40 percent Accufluor 1000 mixed with an amount of from about 0 to about 40 percent, preferably from about 1 to about 35 percent Accufluor 2065. All other combinations of mixing the different forms of Accufluor are possible. A preferred mixture is from about 0 to about 15 percent Accufluor 2028 mixed with from about 2 to about 3.5 percent Accufluor 2010. Another preferred mixture is from about 5 to about 10 percent Accufluor 2028 mixed with from about 2.0 to about 3.0 percent Accufluor 2010. A particularly preferred mixture is from about 2 to about 3 percent Accufluor 2028 mixed with from about 2.5 to about 3 percent Accufluor 2010, and even more preferred is a mixture of about 3 percent Accufluor 2010 and about 2 percent Accufluor 2028. All the above percentages are by weight of the total solids.

Preferred resistivity ranges may vary for bias charging systems designed to operate at different throughput speeds and is selected to correspond to the roller or belt surface speed and nip region dimension such that the time necessary to transmit a charge from the conductive core to the external surface of the bias charging system member is roughly greater than the dwell time for any point on the bias charging system member in the transfer nip region.

Ideally, the external voltage profile of the bias charging system member provides a field strength below that which is necessary for substantial air ionization in the air gap at the entrance of the nip, and above that required for air ionization in the air gap just beyond the exit of the nip. As a general rule, the magnitude of the electric field increases significantly from the pre-nip entrance toward the post-nip exit while the field within the relaxable layer diminishes.

Examples of the elastomers for use in the outer surface 5 and intermediate surface 6 of the bias charging system members include fluoroelastomers. Specifically, suitable fluoroelastomers are those described in detail in U.S. Pat. Nos. 5,166,031, 5,281,506, 5,366,772 and 5,370,931, together with U.S. Pat. Nos. 4,257,699, 5,017,432 and 5,061,965, the disclosures of which are incorporated by reference herein in their entirety. As described therein these fluoroelastomers, particularly from the class of copolymers and terpolymers of vinylidenefluoride hexafluoropropylene and tetrafluoroethylene, are known commercially under various designations as VITON A®, VITON E®, VITON E60C®, VITON E430®, VITON 910®, VITON GH® and VITON GF®. The VITON® designation is a Trademark of E.I. DuPont de Nemours, Inc. Other commercially available materials include FLUOREL 2170®, FLUOREL 2174®, FLUOREL 2176®, FLUOREL 2177® and FLUOREL LVS 76® FLUOREL® being a Trademark of 3M Company. Additional commercially available materials include AFLAS™ a poly(propylene-tetrafluoroethylene) and FLUOREL II® (LII900) a poly(propylene-tetrafluoroethylenevinylidenefluoride) both also available from 3M Company, as well as the Tecnoflons identified as FOR60KIR®, FOR-LHF®, NM® FOR-THF®, FOR-TFS®, TH®, TN505® available from Montedison Specialty Chemical Company. Other elastomers useful in the present invention include silicone rubbers, polyurethane, ethylene-propylene-diene monomer (hereinafter "EPDM"), nitrile butadiene rubber (hereinafter "NBR"), epichlorohydrin, styrene-butadiene, fluorosilicone, and copolymers thereof. These elastomers, along with adhesives, can also be included as intermediate layer(s) (7 in FIG. 3).

Preferred elastomers useful for the outer surface 5 of the bias charging system members include fluoroelastomers, such as fluoroelastomers of vinylidenefluoride based fluoroelastomers, which contain hexafluoropropylene and tetrafluoroethylene as comonomers. Two preferred known fluoroelastomers are (1) a class of copolymers of vinylidenefluoride and hexafluoropropylene known commercially as VITON A® and (2) a class of terpolymers of vinylidenefluoride, hexafluoropropylene and tetrafluoroethylene known commercially as VITON B®. VITON A®, and VITON B®, and other VITON® designations are trademarks of E.I. DuPont de Nemours and Company. Other commercially available materials include FLUOREL TM of 3M Company, VITON GH®, VITON E60C®, VITON B 910®, and VITON E 430®.

In another preferred embodiment, the fluoroelastomer is one having a relatively low quantity of vinylidenefluoride, such as in VITON GF®, available from E.I. DuPont de Nemours, Inc. The VITON GF® has 35 mole percent of vinylidenefluoride, 34 mole percent of hexafluoropropylene and 29 mole percent of tetrafluoroethylene with 2 percent cure site monomer. Examples of cure site monomers include 4-bromoperfluorobutene-1, 1,1-dihydro4-bromoperfluorobutene-1, 3-bromoperfluoropropene-1, 1,1-dihydro-3-bromoperfluoropropene-1, and commercially available cure site monomers available from, for example, DuPont. Also preferred are VITON® B50 and VITON® E45. The fluoroelastomer of the outer surface is filled with fluorinated carbon.

Examples of elastomers suitable for use herein also include elastomers of the above type, along with volume grafted elastomers. Volume grafted elastomers are a special form of hydrofluoroelastomer and are substantially uniform integral interpenetrating networks of a hybrid composition of a fluoroelastomer and a polyorganosiloxane, the volume graft having been formed by dehydrofluorination of fluoroelastomer by a nucleophilic dehydrofluorinating agent, followed by addition polymerization by the addition of an alkene or alkyne functionally terminated polyorganosiloxane and a polymerization initiator.

Volume graft, in embodiments, refers to a substantially uniform integral interpenetrating network of a hybrid composition, wherein both the structure and the composition of the fluoroelastomer and polyorganosiloxane are substantially uniform when taken through different slices of the bias charging member. A volume grafted elastomer is a hybrid composition of fluoroelastomer and polyorganosiloxane formed by dehydrofluorination of fluoroelastomer by nucleophilic dehydrofluorinating agent followed by addition polymerization by the addition of alkene or alkyne functionally terminated polyorganosiloxane.

Examples of specific volume graft elastomers are disclosed in U.S. Pat. No. 5,166,031; U.S. Pat. No. 5,281,506; U.S. Pat. No. 5,366,772; and U.S. Pat. No. 5,370,931, the disclosures of which are herein incorporated by reference in their entirety.

Interpenetrating network, in embodiments, refers to the addition polymerization matrix where the fluoroelastomer and polyorganosiloxane polymer strands are intertwined in one another.

Hybrid composition, in embodiments, refers to a volume grafted composition which is comprised of fluoroelastomer and polyorganosiloxane blocks randomly arranged.

Generally, the volume grafting according to the present invention is performed in two steps, the first involves the dehydrofluorination of the fluoroelastomer preferably using an amine. During this step, hydrofluoric acid is eliminated which generates unsaturation, carbon to carbon double bonds, on the fluoroelastomer. The second step is the free radical peroxide induced addition polymerization of the alkene or alkyne terminated polyorganosiloxane with the carbon to carbon double bonds of the fluoroelastomer. In embodiments, copper oxide can be added to a solution containing the graft copolymer. The dispersion is then provided onto the bias charging member.

In embodiments, the polyorganosiloxane having functionality according to the present invention has the formula:

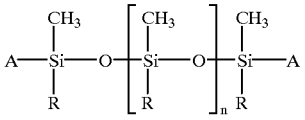

where R is an alkyl of from about 1 to about 24 carbons, or an alkenyl of from about 2 to about 24 carbons, or a substituted or unsubstituted aryl of from about 4 to about 18 carbons; A is an aryl of from about 6 to about 24 carbons, a substituted or unsubstituted alkene of from about 2 to about 8 carbons, or a substituted or unsubstituted alkyne of from about 2 to about 8 carbons; and n is from about 2 to about 400, and preferably from about 10 to about 200 in embodiments.

In embodiments, R is an alkyl, alkenyl or aryl, wherein the alkyl has from about 1 to about 24 carbons, preferably from about 1 to about 12 carbons; the alkenyl has from about 2 to about 24 carbons, preferably from about 2 to about 12 carbons; and the aryl has from about 6 to about 24 carbon atoms, preferably from about 6 to about 18 carbons. R may be a substituted aryl group, wherein the aryl may be substituted with an amino, hydroxy, mercapto or substituted with an alkyl having for example from about 1 to about 24 carbons and preferably from 1 to about 12 carbons, or substituted with an alkenyl having for example from about 2 to about 24 carbons and preferably from about 2 to about 12 carbons. In a preferred embodiment, R is independently selected from methyl, ethyl, and phenyl. The functional group A can be an alkene or alkyne group having from about 2 to about 8 carbon atoms, preferably from about 2 to about 4 carbons, optionally substituted with an alkyl having for example from about 1 to about 12 carbons, and preferably from about 1 to about 12 carbons, or an aryl group having for example from about 6 to about 24 carbons, and preferably from about 6 to about 18 carbons. Functional group A can also be mono-, di-, or trialkoxysilane having from about 1 to about 10 and preferably from about 1 to about 6 carbons in each alkoxy group, hydroxy, or halogen. Preferred alkoxy groups include methoxy, ethoxy, and the like. Preferred halogens include chlorine, bromine and fluorine. A may also be an alkyne of from about 2 to about 8 carbons, optionally substituted with an alkyl of from about 1 to about 24 carbons or aryl of from about 6 to about 24 carbons. The group n is from about 2 to about 400, and in embodiments from about 2 to about 350, and preferably from about 5 to about 100. Furthermore, in a preferred embodiment n is from about 60 to about 80 to provide a sufficient number of reactive groups to graft onto the fluoroelastomer. In the above formula, typical R groups include methyl, ethyl, propyl, octyl, vinyl, allylic crotnyl, phenyl, naphthyl and phenanthryl, and typical substituted aryl groups are substituted in the ortho, meta and para positions with lower alkyl groups having from about 1 to about 15 carbon atoms. Typical alkene and alkenyl functional groups include vinyl, acrylic, crotonic and acetenyl which may typically be substituted with methyl, propyl, butyl, benzyl, tolyl groups, and the like.

The preferred elastomers for the intermediate layer 6 of the present charging members include EPDM (ethylene propylene diene monomer), silicone rubbers, urethane, styrene butadiene, fluorosilicone, epichlorohydrin, and copolymers thereof. Optionally, the intermediate layer 6 may be loaded with conductive materials such as metal oxides such as titanium oxide, zinc oxide, tin oxide, antimony dioxide, indium oxide, indium tin oxide, and the like; and carbons such as carbon black, carbon graphite, and the like.

The amount of fluoroelastomer used to provide the surface of the present invention is dependent on the amount necessary to form the desired thickness of the layer or layers of surface material. Specifically, the fluoroelastomer is added in an amount of from about 50 to about 99 percent, preferably about 70 to about 99 percent by weight of total solids. The amount of rubber included in the intermediate layer is preferably from about 60 to about 99 percent, preferably from about 60 to about 99 percent by weight of total solids.

Any known solvent suitable for dissolving a fluoroelastomer may be used in the present invention. Examples of suitable solvents for the present invention include methyl ethyl ketone, methyl isobutyl ketone, diethyl ketone, cyclohexanone, n-butyl acetate, amyl acetate, and the like. The purpose of the solvent is to wet the fluorocarbon. Specifically, the solvent is added in an amount of from about 25 to about 99 percent, preferably from about 70 to about 95 percent.

The dehydrofluorinating agent which attacks the fluoroelastomer generating unsaturation is selected from basic metal oxides such as MgO, CaO, $Ca(OH)_2$ and the like, and strong nucleophilic agents such as primary, secondary and tertiary, aliphatic and aromatic amines, where the aliphatic and aromatic amines have from about 2 to about 15 carbon atoms. Also included are aliphatic and aromatic diamines and triamines having from about 2 to about 30 carbon atoms where the aromatic groups may be benzene, toluene, naphthalene, anthracene, and the like. It is generally preferred for the aromatic diamines and triamines that the aromatic group be substituted in the ortho, meta and para positions. Typical substituents include lower alkyl amino groups such as ethylamino, propylamino and butylamino, with propylamino being preferred. The particularly preferred curing agents are the nucleophilic curing agents such as VITON CURATIVE VC-50® which incorporates an accelerator (such as a quaternary phosphonium salt or salts like VC-20) and a crosslinking agent (bisphenol AF or VC-30); DIAK 1 (hexamethylenediamine carbamate) and DIAK 3 (N,N'-dicinnamylidene-1,6 hexanediamine). VC-50 is preferred due to the more thermally stable product it provides. The dehydrofluorinating agent is added in an amount of from about 0.5 to about 20 weight percent, and preferably from about 1 to about 10 weight percent.

The bias charging member may take any suitable form such as a roller, blade, belt, brush or the like. In the case of a roller, the conductive core for the bias charging system member, including bias charging roller, according to the present invention may be of any suitable conductive material. Typically, it takes the form of a cylindrical tube or a solid cylindrical shaft of aluminum, copper, stainless steel, iron, or certain plastic materials chosen to maintain rigidity, structural integrity and capable of readily responding to a biasing potential placed thereon. It is preferred to use a solid cylindrical shaft of aluminum or stainless steel. In preferred embodiment, the diameter of the cylindrical shaft is from about 3 to about 10 mm, and the length is from about 10 to about 500 mm.

The core houses the bias potential member. The bias is typically controlled by use of a DC potential, and an AC potential is typically used along with the DC controlling potential to aid in charging control. The advantage of using AC lies in the reduction of the surface contamination sensitivity. The AC creates a corona in the pre and post nip regions of the devices so that the charging component related to the charge injection in the nip is less important. The AC bias system is proportional to the process speed. This sometimes limits the application of bias devices to low speed machines. Use of AC in addition to DC increases the cost of the system. Therefore it is desirable to use only a DC. However, use of only DC bias usually requires materials with an optimum, stable resistivity. Otherwise, use of a single DC bias will result in charging non-uniformity and pre-nip breakdown. Since the present surfaces, in embodiments, allow for optimum and stable resistivities as set forth above, the bias system member of the present invention may only include a DC bias charging system, without the need for an AC bias. In addition, the present invention can be used with electroded field tailoring with an electroded substrate, or with double bias field tailoring without electrodes. These latter two approaches are useful with a stationary film charging system or bias transfer rolls. Also, in embodiments, the present invention may be used in double bias systems, such as electroded and/or non-electroded rollers or film chargers. This allows for selective tuning of the system to post-nip breakdown, thereby improving the charge uniformity. Post-nip breakdown is more uniform than pre-nip breakdown. By choosing a specific material for the outer layer of the bias charging roll such as described herein, the resistivity can be set within the desired range so that only post-nip breakdown occurs. Further, by biasing post-nip and pre-nip differently, post-nip discharge can be achieved. The term in art for selectively biasing post-nip is referred to as field tailoring.

Optional intermediate adhesive layers 7 and/or elastomer layers 7 may be applied to achieve desired properties and performance objectives of the present invention. An adhesive intermediate layer may be selected from, for example, epoxy resins and polysiloxanes. Preferred adhesives are proprietary materials such as THIXON 403/404, Union Carbide A-1100, Dow TACTIX 740, Dow TACTIX 741, and Dow TACTIX 742. A particularly preferred curative for the aforementioned adhesives is Dow H41.

The bias charging system member may have an outer layer of a fluorinated carbon filled fluoroelastomer 5 provided directly on the core. In this configuration, it is preferred that the outer layer have a resistivity of from about $10^3$ to about $10^{10}$ ohm-cm, and particularly preferably of from $10^4$ to about $5\times10^8$ ohm-cm. Also, with this configuration, the thickness of the outer surface layer is from about 0.5 to about 5 mm, preferably from about 1 to about 4 mm. The shore hardness of the outer layer in this configuration is less than 60 Shore A, preferably from about 10 to about 50 Shore A, particularly preferred from about 20 to about 40 Shore A.

Optionally, an elastomer layer 6 may be provided on the core, and a fluorinated carbon filled fluoroelastomer outer surface layer 5 provided on the elastomer layer 6. In this preferred configuration, the conductive rubber layer 6 has a resistivity of about less than $5\times10^8$ ohm-cm, preferably from about $10^2$ to about $10^7$ ohm-cm. The conductive rubber intermediate layer 6 has a thickness of from about 0.5 to about 5 mm, preferably from about 1 to about 4 mm. In this configuration which includes a conductive rubber intermediate layer 6, the outer surface layer 5 comprising a fluorinated carbon filled fluoroelastomer has a resistivity of from about $10^5$ to about $10^{12}$ ohm-cm, preferably from about $10^7$ to about $10^{11}$ ohm-cm. Also, in this configuration, the outer fluorinated carbon filled fluoroelastomer layer 5 has a thickness of from about 1 to about 500 $\mu$m, preferably from about 20 to about 100 $\mu$m. The hardness of the outer layer 5 in this configuration is about less than 90 Shore A, preferably from about 10 to about 70 Shore A, and particularly preferred from about 30 to about 60. The hardness of the intermediate layer 6 in this configuration is from about 70, preferably from about 20 to about 50.

The fluoroelastomer layer of the present invention should have sufficient resiliency to allow the bias charging member to become slightly deformed when brought into moving contact with an opposing member such as a photoreceptor. The intermediate layer has sufficient resiliency to allow the roll to deform when brought into moving contact with a photoconductor surface and in the case of a bias charging roller, to provide an extended contact region in which the charged particles can be transferred between the contact bodies. The intermediate layer should be capable of responding rapidly to the biasing potential to impart electrically the charge potential on the core to the outer surface.

When the intermediate layer is an elastomer layer, there may be provided an adhesive layer (not shown in the figures) between the core and the intermediate layer 6. There may also be another adhesive layer 7 between the intermediate layer 6 and the outer layer 5. In the absence of an intermediate layer, the fluorinated carbon filled fluoroelastomer layer may be provided directly onto the core or may be bonded to the core via an adhesive layer.

The outer layer of the bias charging member is preferably prepared by mixing a solvent such as methyl ethyl ketone, methyl isobutyl ketone and the like with the desired type(s) and amount(s) of fluorinated carbon, along with steel shots for mixing. The mixture is stirred to allow the fluorinated carbon to become wet from the solvent (approximately 1 minute). Next, an amount of elastomer, preferably a fluoroelastomer, is added and the contents are mixed (approximately 20–40 minutes, and preferably 30 minutes). A curative and stabilizer (for example, methanol) are then added and mixed again (approximately 15 minutes). The final solid content of the dispersion is from about 1 to about 30 percent, and preferably from about 2 to about 25 percent by weight. The steel shot is filtered, the dispersion collected and then coated onto the substrate. The coated layers are first air-dried (approximately 2–5 hours) and then step heat cured (65° C. for 4 hours, 93° C. for 2 hours, 144° C. for 2 hours, 177° C. for 2 hours, 204° C. for 2 hours and 232° C. for 16 hours).

Curing may be effected for from about 1 hour to about 48 days, preferably from about 1 to about 16 hours at a temperature of from about 25 to about 250° C., and preferably from about 100 to about 235° C.

The intermediate and outer surfaces are deposited on the substrate via spinning, dipping, rolling, spraying such as by multiple spray applications of very thin films, casting, plasma deposition, flow roll coating, or by other suitable, known methods.

The bias charging members herein having outer surface layers comprising fluorinated carbon filled fluoroelastomers exhibit superior electrical and mechanical properties. The members are designed so as to enable control of electrical properties including control of conductivity in the desired resistivity range. Also, the resistivity is uniform across the entire length of the bias charging member. Further, the bias members herein have decreased sensitivities to changes in temperature, relative humidity, corona exposure, corrosive environments, solvent treatment, cycling to high electric fields, and running time. Moreover, the bias members herein exhibit a decrease in contamination of other xerographic components such as photoconductors. Furthermore, the resistivities of the surface of the charging members of the present invention, in embodiments, allows for use of a single DC bias.

All the patents and applications referred to herein are hereby specifically, and totally incorporated herein by reference in their entirety in the instant specification.

The following Examples further define and describe embodiments of the present invention. Unless otherwise indicated, all parts and percentages are by weight

EXAMPLES

Example I

A resistive layer containing 30% by weight of Accufluor 2028 in Viton GF was prepared in the following manner. The coating dispersion was prepared by first adding a solvent (200 g of methyl ethyl ketone), a steel shot (2,300 g) and 19.5 g of Accufluor 2028 in a small bench top attritor (model 01A). The mixture was stirred for about one minute so that the fluorinated carbon became wet. A polymer binder, Viton GF (45 g) was then added and the resulting mixture was attrited for 30 minutes. A curative package (2.25 g VC-50, 0.9 g Maglite-D and 0.2 G $CA(OH)_2$) and a stabilizing solvent (10 g methanol) were then introduced and the resulting mixture was further mixed for another 15 minutes. After filtering the steel shot through a wire screen, the dispersion was collected in a polypropylene bottle. The resulting dispersion was then coated onto Kaptan substrates within 2–4 hours using a Gardner Laboratory coater. The coated layers were air-dried for approximately two hours and then step heat cured in a programmable oven. The heating sequence was as follows: (1) 65° C. for 4 hours, (2) 93° C. for 2 hours, (3) 144° C. for 2 hours, (4) 177° C. for 2 hours, (5) 204° C. for 2 hours and (6) 232° C. for 16 hours. This resulted in a Viton layer containing 30% by weight Accufluor 2028. The dry thickness of the layers was determined to be ~3 mil (~75 $\mu$m).

The surface resistivity of the cured Viton layers was measured by a Xerox Corporation in-house testing apparatus consisting of a power supply (Trek 601 C Coratrol), a Keithy electrometer (model 610B) and a two point conformable guarded electrode probe (15 mm spacing between the two electrodes). The field applied for the measurement was 500 V/cm and the measured current was converted to surface resistivity based on the geometry of the probe. The surface resistivity of the layer was determined to be ~$1\times10^9$ ohm/sq.

The volume resistivity of the layer was determined by the standard AC conductivity technique. In this case, the surface of the Viton was coated directly onto a stainless steel substrate, in the absence of an intermediate layer. An evaporated aluminum thin film (300 Å) was used as the counter electrode. The volume resistivity was found to be ~$1\times10^9$ ohm-cm at an electric field of 1500 V/cm. Surprisingly, the resistivity was found to be insensitive to changes in temperature in the range of about 20° C. to about 150° C., and to changes in relative humidity in the range of about 20% to about 80%, and to the intensity of applied electric field (up to 2000 V/cm). Furthermore, no hysteresis (memory) effect was seen after the layer was cycled to higher electric fields (>$10^4$ V/cm).

Example II

A number of resistive layers were prepared using various percentages by weight of Accufluor 2028 and Accufluor 2010 following the procedures described in Example I. These layers were found to exhibit very similar electric properties as the layers in Example 1 when measured following the same procedures. The data is summarized in Table I.

TABLE 1

Resistivity Data of Fluorinated Carbon in Viton GF (field ~ 1500 V/cm)

| Fluorinated Carbon | Loading (% by weight) | Surface Resistivity (ohm/sq) | Volume Resistivity (ohm-cm) |
|---|---|---|---|
| Accufluor 2028 | 35 | $1.7 \times 10^7$ | ~$1.6 \times 10^8$ |
| Accufluor 2028 | 25 | $1.0 \times 10^{10}$ | ~$6 \times 10^9$ |
| Accufluor 2028 | 20 | $8.9 \times 10^{11}$ | ~$5 \times 10^{11}$ |
| Accufluor 2010 | 30 | $8.3 \times 10^4$ | |
| Accufluor 2010 | 10 | $1.9 \times 10^5$ | |
| Accufluor 2010 | 5 | $4.1 \times 10^5$ | |
| Accufluor 2010 | 3.5 | $4.5 \times 10^6$ | |
| Accufluor 2010 | 3 | $1.7 \times 10^8$ | |

Example III

A number of resistive layers were prepared using the dispersing and coating procedure as described in Example I, with the exception that a mixture of various percentages by weight of various types of Accufluors were crosslinked to Viton GF. The compositions of the Accufluor/Viton GF layers and the surface resistivity results are summarized in Table 2.

TABLE 2

| Fillers in Viton GF (%) | Surface Resistivity (ohm/sq) |
|---|---|
| 2% Accufluor 2010<br>15% Accufluor 2028 | $4.5 \times 10^{11}$ |
| 2.5% Accufluor 2010<br>15% Accufluor 2028 | $1.0 \times 10^9$ |
| 3% Accufluor 2010<br>5% Accufluor 2028 | $5.4 \times 10^9$ |
| 3% Accufluor 2010<br>10% Accufluor 2028 | $6.4 \times 10^9$ |
| 3% Accufluor 2010<br>15% Accufluor 2028 | $1.3 \times 10^{10}$ |
| 3.5% Accufluor 2010<br>5% Accufluor 2028 | $2 \times 10^9$ |
| 3.5% Accufluor 2010<br>15% Accufluor 2010 | $7.2 \times 10^9$ |

Example IV

Resistive layers consisting of 25% by weight of Accufluor 2028 in Viton GF were prepared according to the procedures described in Example I. However, instead of performing a post-curing at 232° C. for 16 hours, the post-curing was performed for 9 hours, 26 hours, 50 hours, 90 hours and 150 hours, respectively. The surface resistivity results are shown in Table 3.

TABLE 3

| Post-curing Time | Surface Resistivity (ohm/sq) |
|---|---|
| 9 hours | $5.5 \times 10^{10}$ |
| 26 hours | $8.8 \times 10^9$ |
| 50 hours | $1.8 \times 10^9$ |
| 90 hours | $7.3 \times 10^7$ |
| 150 hours | $7.2 \times 10^6$ |

Example V

Coating dispersions containing different concentrations of Accufluor 2010 in Viton GF were prepared using the attrition procedures given in Example I. These dispersions were then air-sprayed onto Kaptan substrates. The layers (~2.5 mil) were air-dried and post-cured using the procedure outlined in Example I. The surface resistivity results are summarized in Table 4 below. The percentages are by weight.

TABLE 4

| Accufluor 2010 Loading in Viton GF (%) | Surface Resistivity (ohm/sq) |
|---|---|
| 6% | $1.6 \times 10^{12}$ |
| 7% | $7.0 \times 10^8$ |
| 8% | $8.5 \times 10^7$ |
| 10% | $6.2 \times 10^6$ |
| 20% | $1.1 \times 10^5$ |

Example VI

A resistive layer consisting of 30% Accufluor 2028 in Viton was prepared according to the procedures described in Example I, with the exception that 4.5 g of curative VC-50 was used. The surface resistivity of the layer was measured using the techniques outlined in Example 1 and was found to be ~$5.7\times10^9$ ohm/sq.

Example VII

A coating dispersion was prepared by first adding a solvent (200 g of methyl ethyl ketone), a steel shot (2300 g) and 2.4 g of Accufluor 2028 in a small bench top attritor (model 01A). The mixture was stirred for about one minute so that the fluorinated carbon became wet from the solvent. A polymer binder, Viton GF (45 g), was then added and the resulting mixture was attrited for 30 minutes. A curative package (0.68 g DIAK 1 and 0.2 g Maglite Y) and a stabilizing solvent (10 g methanol) were then introduced and the mixture was further mixed for about 15 minutes. After filtering the steel shot through a wire screen, the fluorinated carbon/Viton GF dispersion was collected in a polypropylene bottle. The dispersion was then coated onto Kapton substrates within 2–4 hours using a Gardner laboratory coater. The coated layers were first air-dried for approximately two hours and then heat cured in a programmable oven. The heating sequence was: (1) 65° C. for 4 hours, (2) 93° C. for 2 hours, (3) 144° C. for 2 hours, (4) 177° C. for 2 hours, (5) 204° C. for 2 hours and (6) 232° C. for 16 hours. A resistive layer (~3 mil) consisting of 5% by weight Accufluor 2028 in Viton GF was formed. The surface resistivity of the layer was measured according to procedures in Example I and was found to be $1\times10^8$ ohm/sq.

Example VIII

A resistive layer consisting of 5% by weight Accufluor 2028 in Viton GF was prepared according to the procedures in Example VII, with the exception that 1.36 g of DIAK 1 was used as the curative. The surface resistivity of the layer was measured at $1\times10^5$ ohm/sq.

Example IX

A coating dispersion was prepared by first adding a solvent (200 g of methyl ethyl ketone), a steel shot (2300 g) and 1.4 g of Accufluor 2028 in a small bench top attritor (model 01A). The mixture was stirred for about one minute so that the fluorinated carbon became wet. A polymer binder, Viton GF (45 g), was then added and the resulting mixture was attrited for 30 minutes. A curative package (1.36 g DIAK 3 and 0.2 g Maglite Y) and a stabilizing solvent (10 g methanol) were then introduced and the resulting mixture was further mixed for another 15 minutes. After filtering the steel shot through a wire screen, the fluorinated carbon/Viton GF dispersion was collected in a polypropylene bottle. The dispersion was then coated onto Kapton substrates within 2–4 hours using a Gardner Laboratory coater. The coated layers were first air-dried for approximately 2 hours and then heat cured in a programmable oven. The heat curing sequence was: (1) 65° C. for 4 hours, (2) 93° C. for 2 hours, (3) 144° C. for 2 hours. (4) 177° C. for 2 hours, (5) 204° C. for 2 hours and (6) 232° C. for 16 hours. A resistive layer (~3 mil) consisting of 3% Accufluor 2028 in Viton GF was formed. The surface resistivity of the layer was measured at $\sim8\times10^6$ ohm/sq.

Example X

Resistive layers consisting of 5% Accufluor 2028 in Viton GF were prepared using the dispersion and coating procedures as outlined in Example VII, with the exception that the curing times and the curing temperatures were changed. The surface resistivities of these layers are summarized in Table 5.

TABLE 5

| Curing Temperature (° C.) | Curing time (hours) | Surface Resistivity (ohm/sq) |
|---|---|---|
| 232 | 2 | $3.6\times10^8$ |
| 232 | 4.5 | $1.2\times10^8$ |
| 232 | 8 | $1.0\times10^8$ |
| 195 | 2 | $1.9\times10^{10}$ |
| 195 | 4.5 | $6.0\times10^9$ |
| 195 | 8 | $7.7\times10^9$ |
| 195 | 23 | $3.4\times10^9$ |
| 175 | 4.5 | $5.2\times10^{10}$ |
| 175 | 23 | $2.0\times10^{10}$ |
| 149 | 8 | $5.2\times10^{11}$ |
| 149 | 23 | $2.3\times10^{11}$ |

Example XI

Resistive layers consisting of 3% by weight Accufluor 2028 in Viton GF were prepared using the dispersion and coating procedures as described in Example IX, with the exception that the curing times and the curing temperatures were charged. The surface resistivities of these layers are summarized in Table 6.

TABLE 6

| Curing Temperature (° C.) | Curing Time (hours) | Surface Resistivity (ohm/sq) |
|---|---|---|
| 235 | 2.5 | $8.1\times10^6$ |
| 235 | 6 | $8.0\times10^6$ |
| 235 | 8 | $8.0\times10^6$ |
| 175 | 2.5 | $6.6\times10^8$ |
| 175 | 6 | $4\times10^8$ |
| 175 | 24 | $8.8\times10^7$ |
| 149 | 2.5 | $1.2\times10^{10}$ |
| 149 | 6 | $7.5\times10^9$ |
| 149 | 8.5 | $6.1\times10^9$ |
| 149 | 24 | $2.5\times10^9$ |

Example XII

A bias charging roll can be fabricated from the Accufluor/Viton resistive layers as described herein. For example, a 50 am thick resistive layer, comprised of 70% Accufluor 2010 in Viton GF can be sprayed on a conductive rubber roll, which is made of carbon black and EPDM rubber (3 mm thick). The volume resistivity of the carbon black EPDM rubber will be about $10^6$ ohm-cm. The volume resistivity of the Accufluor/Viton layer is believed to be approximately $10^9$ ohm-cm. This bias charging roll can be used to charge photoreceptors including layered photoconductive imaging member or dielectrics for ionographic processes in printers and copiers.

Example XIII

A bias charging roll can be fabricated using the process of Example XII, with the exception that epichlorohydrin rubber can be used in place of the intermediate EPDM layer. The volume resistivity of the epichlorohydrin rubber layer is believed to be about $10^8$ ohm-cm. The volume resistivity of the outer layer is believed to be about $10^9$ ohm-cm.

Example XIII

A single layer bias charging roll can be fabricated by molding a mixture consisting of Viton GF, Accufluor 2010, curative VC-50, MgO and $Ca(OH)_2$. The thickness of the outer Accufluor/Viton GF layer is believed to be 3 mm thick on an 8 mm diameter shaft (331 mm long). The resistivity of the Accufluor/Viton GF rubber is believed to be about $10^6$ ohm-cm. The roll can be used as a bias charging roll for charging photoreceptors in printers and copiers.

Example XV

A bias charging roll can be fabricated using the process described in Example XII with the exception that a conductive silicone rubber is used in place of the conductive rubber intermediate layer. The silicone rubber intermediate layer can be obtained by molding an electroconductive silicone, such as grade 1216-06-20, obtained from Toshiba Silicones, onto a steel shaft (approximately 8 mm in diameter and 320 mm in length). After curing (with 2,5-dimethyl 2,5-di-t-butylperoxyhexane, about 1.5%, as curative), the thickness of the rubber is believed to be 3 mm and the resistivity of the rubber is believed to be $3\times10^3$ ohm-cm. The hardness is believed to be about 39 Shore A. A 50 micron-thick resistive outer layer, consisting of 7% Accufluor 2010 in Viton GF can be sprayed onto the conductive silicone intermediate layer similar to that described in Example XII. The resistivity of the resistive outer layer is believed to be about $10^9$ ohm-cm. A bias charging roll prepared in this manner is believed to be useful to charge photoreceptors in copiers and printers.

While the invention has been described in detail with reference to specific and preferred embodiments, it will be appreciated that various modifications and variations will be apparent to the artisan. All such modifications and embodiments as may readily occur to one skilled in the art are intended to be within the scope of the appended claims.

We claim:

1. A bias charging member comprising:

a) a conductive core, b) a biasing means and, c) an outer surface layer provided on said conductive core and comprising a fluorinated carbon filled fluoroelastomer, wherein the fluoroelastomer is selected from the group consisting of a) copolymers of vinylidenefluoride and hexafluoropropylene, b) terpolymers of vinylidenefluoride, hexafluoropropylene and tetrafluoroethylene, and c) volume grafted fluoroelastomers, wherein said bias charging member is capable of receiving a bias for contact charging a member to be charged, and wherein said fluorinated carbon is present in an amount of from about 5 to about 15 percent by weight based on the weight of total solids.

2. A bias charging member in accordance with claim 1, wherein the fluorinated carbon has a fluorine content of from about 1 to about 70 weight percent and a carbon content of from about 99 to about 30 weight percent.

3. A bias charging member in accordance with claim 2, wherein the fluorinated carbon has a fluorine content of from about 10 to about 30 weight percent and a carbon content of from about 90 to about 70 weight percent.

4. A bias charging member in accordance with claim 1, wherein the fluorinated carbon is of the formula $CF_x$, wherein x is from about 0.02 to about 1.5.

5. A bias charging member in accordance with claim 4 wherein the fluorinated carbon is of the formula $CF_x$, wherein x is from about 0.04 to about 1.4.

6. A bias charging member in accordance with claim 1, wherein said fluorinated carbon is selected from the group consisting of a fluorinated carbon having a fluorine content of 62 weight percent, a fluorinated carbon having a fluorine content of 11 weight percent, a fluorinated carbon having a fluorine content of 28 weight percent, and a fluorinated carbon having a weight content of 65 weight percent.

7. A bias charging member in accordance with claim 6, wherein the fluorinated carbon comprises from about 5 to about 10 percent by weight of a fluorinated carbon having a fluorine content of 28 weight percent, and from about 2 to about 3 percent by weight of a fluorinated carbon having a fluorine content of 11 weight percent, said weight percents based on the weight of total solids.

8. A bias charging member in accordance with claim 7, wherein the fluorinated carbon comprises from about 2 to about 3 percent by weight of a fluorinated carbon having a fluorine content of 28 weight percent, and from about 2.5 to about 3 percent by weight of a fluorinated carbon having a fluorine content of 11 weight percent, said weight percents based on the weight of total solids.

9. A bias charging member in accordance with claim 8, wherein the fluorinated carbon comprises from about 2 weight percent of a fluorinated carbon having a fluorine content of 28 weight percent, and 3 percent by weight of a fluorinated carbon having a fluorine content of 11 weight percent, said weight percents based on the weight of total solids.

10. A bias charging member in accordance with claim 1, wherein the fluoroelastomer is a copolymer of vinylidenefluoride and hexafluoropropylene.

11. A bias charging member in accordance with claim 1, wherein the fluoroelastomer is a terpolymer of vinylidenefluoride, hexafluoropropylene and tetrafluoroetheylene.

12. A bias charging member in accordance with claim 1, wherein the fluoroelastomer comprises 35 mole percent of vinylidenefluoride, 34 mole percent of hexafluoropropylene and 29 mole percent of tetrafluoroethylene.

13. A bias charging member in accordance with claim 12, wherein said terpolymer further comprises 2 mole percent cure site monomer.

14. A bias charging member in accordance with claim 1, wherein the fluoroelastomer is present in an amount of from about 70 to about 99 percent by weight of total solids.

15. A bias charging member in accordance with claim 1, wherein the outer layer is contained on said core and has a volume resistivity of from about $10^3$ to about $10^{12}$ ohm-cm.

16. A bias charging member in accordance with claim 15, wherein the outer layer is contained on said core and has a volume resistivity of from about $10^4$ to about $5\times10^8$ ohm-cm.

17. A bias charging member in accordance with claim 1, wherein the outer layer has a hardness of from about 10 to about 50 Shore A durometer.

18. A bias charging member in accordance with claim 1, wherein the outer layer has a thickness of from about 0.5 to about 5 mm.

19. A bias charging member in accordance with claim 1, wherein the conductive core possesses an AC and a DC bias potential.

20. A bias charging member in accordance with claim 1, wherein the conductive core possesses a single DC bias potential.

21. A bias charging member in accordance with claim 1, further including at least one intermediate layer positioned between said conductive core and said outer layer.

22. A bias charging member in accordance with claim 21, wherein said intermediate layer is an adhesive layer or an elastomer layer.

23. A bias charging member in accordance with claim 21, wherein the intermediate layer is an elastomer layer comprising an elastomer selected from the group consisting of silicone rubbers, ethylene-propylene-diene monomer, epichlorohydrin, styrene-butadiene, fluorosilicone, polyurethane and copolymers thereof.

24. A bias charging member in accordance with claim 21, wherein the intermediate layer has a thickness of from about 1 to about 4 mm, and the outer layer has a thickness of from about 20 to about 100 micrometers.

25. A bias charging member in accordance with claim 21, wherein the intermediate layer further comprises a filler selected from the group consisting of carbon black, graphite, titanium oxide, zinc oxide, tin oxide, antimony oxide, indium oxide, indium tin oxide, and mixtures thereof.

26. A bias charging member in accordance with claim 25, wherein the filler is carbon black.

27. A bias charging member in accordance with claim 21, wherein the intermediate layer has a volume resistivity of from about less than $5\times10^8$ ohm-cm and the outer layer has a volume resisitivity of from about $10^5$ to about $10^{12}$ ohm-cm.

28. A bias charging member in accordance with claim 27, wherein said intermediate layer has a volume resistivity of from about $10^2$ to about $10^7$ ohm-cm and the outer layer has a volume resistivity of from about $10^7$ to about $10^{11}$ ohm-cm.

29. A bias charging member in accordance with claim 21, wherein said intermediate layer has a hardness of from about 20 to about 50 Shore A, and the outer layer has a hardness of from about 10 to about 70 Shore A durometer.

30. A bias charging member in accordance with claim 21, wherein the conductive core possesses an AC and a DC bias potential.

31. A bias charging member in accordance with claim 21, wherein the conductive core possesses a single DC bias potential.

32. A bias charging member in accordance with claim 21, wherein the conductive core having said outer layer is in the form of a solid cylindrical shaft comprised of a compound selected from the group consisting of aluminum and stainless steel.

33. A bias charging member in accordance with claim 1, wherein the conductive core with said outer layer is in the form of an endless belt.

34. A bias charging member in accordance with claim 1, wherein the conductive core having said outer layer is in the form of a solid cylindrical shaft comprised of a compound selected from the group consisting of aluminum and stainless steel.

35. A bias charging member in accordance with claim 1, wherein the fluoroelastomer is a terpolymer of vinylidenefluoride, hexafluoropropylene and tetrafluoroethylene, and further comprises a cure site monomer.

36. A bias charging member in accordance with claim 1, wherein said fluorinated carbon is a mixture of a first fluorinated carbon $CF_x$ and a second fluorinated carbon $CF_x$, wherein x for the first fluorinated carbon is different from x for the second fluorinated carbon.

37. A bias charging member in accordance with claim 36, wherein said first fluorinated carbon $CF_x$ has a value of x such that the first fluorinated carbon has a fluorine content of about 28 percent by weight and said second fluorinated carbon $CF_x$ has a value of x such that the second fluorinated carbon has a fluorine content of about 11 percent by weight.

38. A bias charging member in accordance with claim 36, wherein said first fluorinated carbon $CF_x$ has a value of x such that the first fluorinated carbon has a fluorine content of about 62 percent by weight and said second fluorinated carbon $CF_x$ has a value of x such that the second fluorinated carbon has a fluorine content of about 65 percent by weight.

39. A bias charging member comprising:

a) a conductive core;

b) a biasing means; and c) an outer surface layer provided on said conductive core and comprising a fluorinated carbon filled fluoroelastomer, wherein the fluorinated carbon is of the formula $CF_x$, wherein x represents the number of fluorine atoms and is from about 0.02 to about 1.5 and said fluoroelastomer is selected from the group consisting of 1) copolymers of vinylidenefluoride and hexafluoropropylene, and 2) terpolymers of vinylidenefluoride, hexafluoropropylene and tetrafluoroethylene, wherein said bias charging member is capable of receiving a bias for contact charging a member to be charged.

40. A bias charging member comprising:

a) a conductive core;

b) a biasing means;

c) an intermediate layer provided on the conductive core, said intermediate layer comprising an elastomer selected from the group consisting of silicone rubbers, ethylene-propylene-diene monomer, epichlorohydrin, styrene-butadiene, fluorosilicone, polyurethane elastomers and copolymers thereof; and d) an outer surface layer provided on said intermediate layer and comprising a fluorinated carbon filled fluoroelastomer, wherein the fluorinated carbon is of the formula $CF_x$, wherein x represents the number of fluorine atoms and is from about 0.02 to about 1.5 and said fluoroelastomer is selected from the group consisting of 1) copolymers of vinylidenefluoride and hexafluoropropylene, and 2) terpolymers of vinylidenefluoride, hexafluoropropylene and tetrafluoroethylene, wherein said bias charging member is capable of receiving a bias for contact charging a member to be charged.

* * * * *